US006023813A

United States Patent [19]

Thatcher et al.

[11] Patent Number: 6,023,813

[45] Date of Patent: Feb. 15, 2000

[54] POWERED FLOOR SCRUBBER AND BUFFER

[75] Inventors: David Thatcher, Logan; Colby Haas, Providence; Brian Clark, Paradise, all of Utah

[73] Assignee: Spectrum Industrial Products, Inc., Logan, Utah

[21] Appl. No.: 09/056,612

[22] Filed: Apr. 7, 1998

[51] Int. Cl.[7] ..... A47L 11/293

[52] U.S. Cl. ..... 15/320; 15/340.1; 15/340.4

[58] Field of Search ..... 15/52, 98, 320, 15/340.1, 340.2, 340.3, 340.4

[56] References Cited

U.S. PATENT DOCUMENTS

| | | | |
|---|---|---|---|
| 3,204,280 | 9/1965 | Campbell | 15/340.3 |
| 3,742,546 | 7/1973 | Crener et al. . | |
| 3,795,933 | 3/1974 | Seufert . | |
| 3,921,244 | 11/1975 | Warren et al. . | |
| 3,931,659 | 1/1976 | Pfefferkorn et al. . | |
| 3,942,215 | 3/1976 | Olds | 15/340.4 |
| 3,952,361 | 4/1976 | Wilkins . | |
| 3,972,088 | 8/1976 | Thomas . | |
| 4,059,863 | 11/1977 | Deuchar et al. | 15/98 |
| 4,094,034 | 6/1978 | Wilkins et al. . | |
| 4,096,084 | 6/1978 | Thomsen et al. . | |
| 4,118,819 | 10/1978 | Gordon et al. . | |
| 4,122,576 | 10/1978 | Bevington et al. . | |
| 4,150,456 | 4/1979 | Alvarez et al. . | |
| 4,214,337 | 7/1980 | Nise et al. . | |
| 4,237,571 | 12/1980 | Nelson . | |
| 4,295,243 | 10/1981 | King . | |
| 4,322,920 | 4/1982 | Wells . | |
| 4,393,534 | 7/1983 | Lee et al. . | |
| 4,506,405 | 3/1985 | Block . | |
| 4,577,364 | 3/1986 | Demetriades . | |
| 4,633,541 | 1/1987 | Block . | |
| 4,783,872 | 11/1988 | Burhoe . | |
| 4,910,824 | 3/1990 | Nagayama et al. . | |
| 4,940,082 | 7/1990 | Roden | 15/321 |
| 5,253,384 | 10/1993 | Joines et al. . | |
| 5,287,581 | 2/1994 | Lo | 15/52 |
| 5,289,605 | 3/1994 | Armbruster . | |
| 5,371,912 | 12/1994 | Hall . | |
| 5,402,559 | 4/1995 | Allison et al. . | |
| 5,467,500 | 11/1995 | O'Hara et al. | 15/340.4 |
| 5,611,105 | 3/1997 | Blehert et al. | 15/340.4 |
| 5,742,975 | 4/1998 | Knowlton et al. | 15/340.3 |

*Primary Examiner*—Terrence R. Till
*Attorney, Agent, or Firm*—Lloyd W. Sadler

[57] ABSTRACT

An automatic floor scrubber and buffer is described. This invention provides for simultaneous scrubbing and buffing of floors through the use of a plurality of pads operating at different speeds to optimize the scrubbing and buffing operation of the device. This invention also provides for the application of cleaning solution and the means of removing, collecting and storing the resulting dirty water and cleaning solution prior to the application of the buffers. Moreover, this invention provides the means for easily pivoting the scrubbing and buffing pads, thereby removing them from contact with the floor for transportation, removal or replacement. Also, this invention provides a propane powered drive motor thereby providing improved service life as well as permitting use where electricity is not readily available. In sum, this invention addresses the problem of floor cleaning and polishing and does so by eliminating the need for going over the same floor twice, once to scrub and once to buff, thereby saving the user time as well as eliminating the need for two separate machines.

7 Claims, 11 Drawing Sheets

POWERED FLOOR SCRUBBER AND BUFFER

BACKGROUND OF THE INVENTION

1. Field of the Invention

This invention relates to floor cleaning and polishing machines. More specifically, this invention relates to powered automatic floor cleaning and polishing machines which scrub, vacuum the cleaning solution and buff simultaneously in a single pass over the floor.

2. Description of Related Art

A wide variety of machines have been developed to clean hard surface floors. Typically, such machines are designed to either clean or polish. Some machines can be selected to do either cleaning or polishing, but generally they do not clean and polish floors simultaneously. Moreover, most such cleaning machines are electrically powered, requiring either power cords or batteries. Both power cords and batteries impose significant limitations on the use of the machines.

Different aspects of floor cleaning machines have be disclosed in U.S. Pat. Nos. 3,742,546, 3,795,933, 3,921,244, 3,931,659, 3,952,361, 3,972,088, 4,094,034, 4,096,084, 4,118,819, 4,122,576, 4,150,456, 4,214,337, 4,237,517, 4,295,243, 4,322,920, 4,393,534, 4,506,405, 4,577,364, 4,633,541, 4,783,872, 4,910,824, 5,253,384, 5,289,605, 5,371,912, 5,402,559, each of which is hereby incorporated by reference in its entirety for the material disclosed therein.

U.S. Pat. No. 3,742,546 discloses a surface treating apparatus having rotatable treating members movable over a surface, a container for liquid wax which is positioned in a compartment and has an outlet at its bottom normally closed by a valve having a vertically movable stem.

U.S. Pat. No. 3,795,933 discloses a multi-purpose cleaning implement includes a base member supporting a sponge mop type work head and an auxiliary implement such as a brush, squeegee, scraper, spreader or similar implement.

U.S. Pat. No. 3,921,244 discloses a floor buffer for operator directed polishing of a floor.

U.S. Pat. No. 3,931,659 discloses a floor treating machine supported at the floor or surface to be treated by means of a work disk arranged beneath a substantially ring-shaped stop member, the work disk being detachably coupled with a drive motor.

U.S. Pat. No. 3,952,361 discloses a floor treating machine having laterally spaced drive wheels driven by separate electric traction motors under electronic control so as to be driven by a separate train of pulses, comprising means for recording the trains of pulses to the traction motors and means for replaying the record to reproduce the trains of pulses whereby the machine will repeat the operation.

U.S. Pat. No. 3,972,088 discloses an electric floor scrubber and buffer having its scrubber or buffer pad attached to the underside of an oscillating plate.

U.S. Pat. No. 4,094,034 discloses a floor treating machine of the rotary brush type in which, in operation, the weight of the machine is, to at least a significant extent, supported by the rotary brush or brushes, in which a brush mounting member is flexibly suspended between resilient elements for limited universal movement.

U.S. Pat. No. 4,096,084 discloses a method for cleaning surfaces such as floors and pavements that includes incorporating a polyelectrolyte in the cleaning solution and a surface scrubbing machine for carrying out the process.

U.S. Pat. No. 4,118,819 discloses a floor treating machine of the single rotary brush type having a handle and a motor both laterally offset from the axis of rotation of the brush in a direction to impart a tilting couple opposed to that arising from operator forces counteracting the reaction couple on the handle.

U.S. Pat. No. 4,122,576 discloses a manually operated floor polishing machine comprising a polishing pad or brush rotatable at a speed above 660 rpm, pressing against the floor with a force of less than about 25 lbs., and positioned so that one segment of the pad presses harder against the floor than the other, such as by mounting the pad's driving plate or disc to that its plane of rotation is at an angle less than about 10° to the plane of the floor.

U.S. Pat. No. 4,150,456 discloses a floor scrubber with a propane powered internal combustion engine which is mounted on a wheeled dolly and which is attached by its rotary output shaft to a circular cage provided with a plurality of rotary brushes on the underside thereof.

U.S. Pat. Nos. 4,214,337 and 4,237,571 disclose a compact floor polishers including a base supporting an electric motor having a vertically oriented output shaft and driving a circular brush.

U.S. Pat. No. 4,295,243 discloses an apparatus for cleaning, waxing, polishing and otherwise treating the surface of a floor, where the apparatus includes a carriage or frame with a handle for guiding and maneuvering, several containers for dispensing several selected types of fluids or solutions to the floor where a reciprocating scrubber, such as steel wool or a buffing pad operates with a solution to effectively clean, strip, wax or polish the floor surface. In addition, there is a vacuum means which removes and carries away any excess liquid, solution or dirty cleaning fluids from the floor surface.

U.S. Pat. No. 4,322,920 discloses an attachment for use on a rotary floor conditioning machine comprising a master block which is integrally molded of a urethane elastomer including a centrally located hub with a circular flange member extending radially from the base thereof.

U.S. Pat. No. 4,393,534 discloses an apparatus for mechanically varying the speed of a disk, such as a floor treating pad, mounted for rotation about the axis of elongation of a shaft powered by a fixed speed motor.

U.S. Pat. No. 4,506,405 discloses a floor treating machine adapted to operate as a floor scrubber and a floor polisher or buffer includes a main housing or support frame structure from which extends a brush housing assembly.

U.S. Pat. No. 4,577,364 discloses a floor cleaning machine including a support frame with a handle attached to the upper end of the support frame for guiding the machine along the floor and a wheel assembly attached to the lower end. A plurality of disc-shaped floor cleaning pads disposed and held adjacent one another such that a floor pad cylinder having a horizontally-disposed and held adjacent one another such that a floor pad cylinder having a horizontally-disposed longitudinal axis is formed are attached to the lower end of the frame.

U.S. Pat. No. 4,633,541 discloses a floor treating machine adapted to operate as a floor scrubber and a floor polisher or buffer which includes a main housing or support frame structure from which extends a brush housing assembly.

U.S. Pat. No. 4,783,872 discloses a high-speed floor treating machine is provided comprising a frame, a control and guiding handle extending rearwardly of the frame and an electric motor for rotating a floor contacting pad is secured.

U.S. Pat. No. 4,910,824 discloses a floor polisher, which causes a pad to rotate at a high speed to polish a floor. The floor polisher has a vertically moving mechanism adapted to move the pad in the vertical direction with respect to the floor, a ground pressure adjusting mechanism adapted to maintain a ground pressure of the pad at a set pressure by controlling the vertically moving mechanism and a floor protecting mechanism adapted to actuate the vertically moving mechanism to lift the pad immediately when the travel of the floor polisher is stopped.

U.S. Pat. No. 5,253,384 discloses an electric buffing machine and a method for buffing waxed floors. The buffing machine comprises a molded plastic housing, a foldable handle and a DC drive motor directly driving a buffing pad holder. U.S. Pat. No. 5,289,605 discloses a cleaning apparatus in the form of a scrubber that is a motor driven by a direct current (DC) motor driving a rotatable scrubber unit which includes a scrubber disc with the motor and scrubber disc forming a power head supported from a detachable and adjustable length pole which enables surfaces that are normally out of reach to be easily scrubbed.

U.S. Pat. No. 5,371,912 discloses an electric floor and baseboard cleaning machine which includes a motor assembly attached to a medium frame in which the movement thereof is adjustable for either straight line or circular motion.

U.S. Pat. No. 5,402,559 discloses a floor scrubber is provided which consists of a rectangular head assembly.

SUMMARY OF THE INVENTION

It is desirable to provide a propane powered automatic floor scrubber and buffer that simultaneously scrubs and buffs in one pass and vacuums dirty cleaning or waxing solution from the floor. Such a floor cleaning and polishing machine is desirable because it eliminates the need to have an operator go over the same floor area twice - once to scrub and once to buff. It is also desirable to combine the cleaning and polishing in one machine because it permits cleaning and buffing to be performed using only one machine rather than two or more machines as are commonly necessary. It is also desirable to provide a floor scrubbing and buffing machine which is powered by propane rather than electricity, thereby eliminating the need for power cords or batteries.

Accordingly, it is the general object of this invention to provide a floor scrubber and buffer that simultaneously scrubs and buffs floors in a one pass operation.

It is a further object of this invention to provide a floor scrubber and buffer which uses propane fuel rather than electricity avoiding the need for power cords or batteries.

It is a still further object of this invention to provide floor scrubber and buffer that puts cleaning and/or polishing solution on the floor, scrubs the floor at a relatively slow speed with circular pads, vacuums the solution from the floor using a squeegee powered by a vacuum, and buffing the floor with two high speed pads following the vacuum.

Another objective of this invention is to provide a floor scrubber and buffer which is powered by a hydraulic motor system capable of providing different speed controls to the scrubber pads and the buffer pads.

These and other objects of this invention will be readily understood by those of ordinary skill in the art upon consideration of the following detailed description, preferred embodiment, drawings and claims of this disclosure.

DETAILED DESCRIPTION OF THE INVENTION

This invention is, in its preferred embodiment, a propane powered automatic floor scrubber and buffer which is designed to both scrub and buff the floor in a single pass and which incorporates a vacuum for removing the soiled solution from the floor prior to buffing. Moreover, this invention provides both the capability of pivoting the scrubbing and buffing pads for ease of transport of the floor scrubber and buffer and to permit the easy removal and replacement of the pads, the capability of pivoting the front (scrubbing) pads with respect to the rear (buffing) pads thereby providing a machine which turns easily even during operation, and to permit the machine to perform either scrubbing or buffing alone. The preferred embodiment of this invention includes a frame, a propane motor, a plurality of liquid storage tanks, a plurality of scrubbing and buffing pads, a plurality of pivots, and a squeegee/vacuum device for removing soiled residue from the floor after scrubbing and before buffing.

Figure 1:
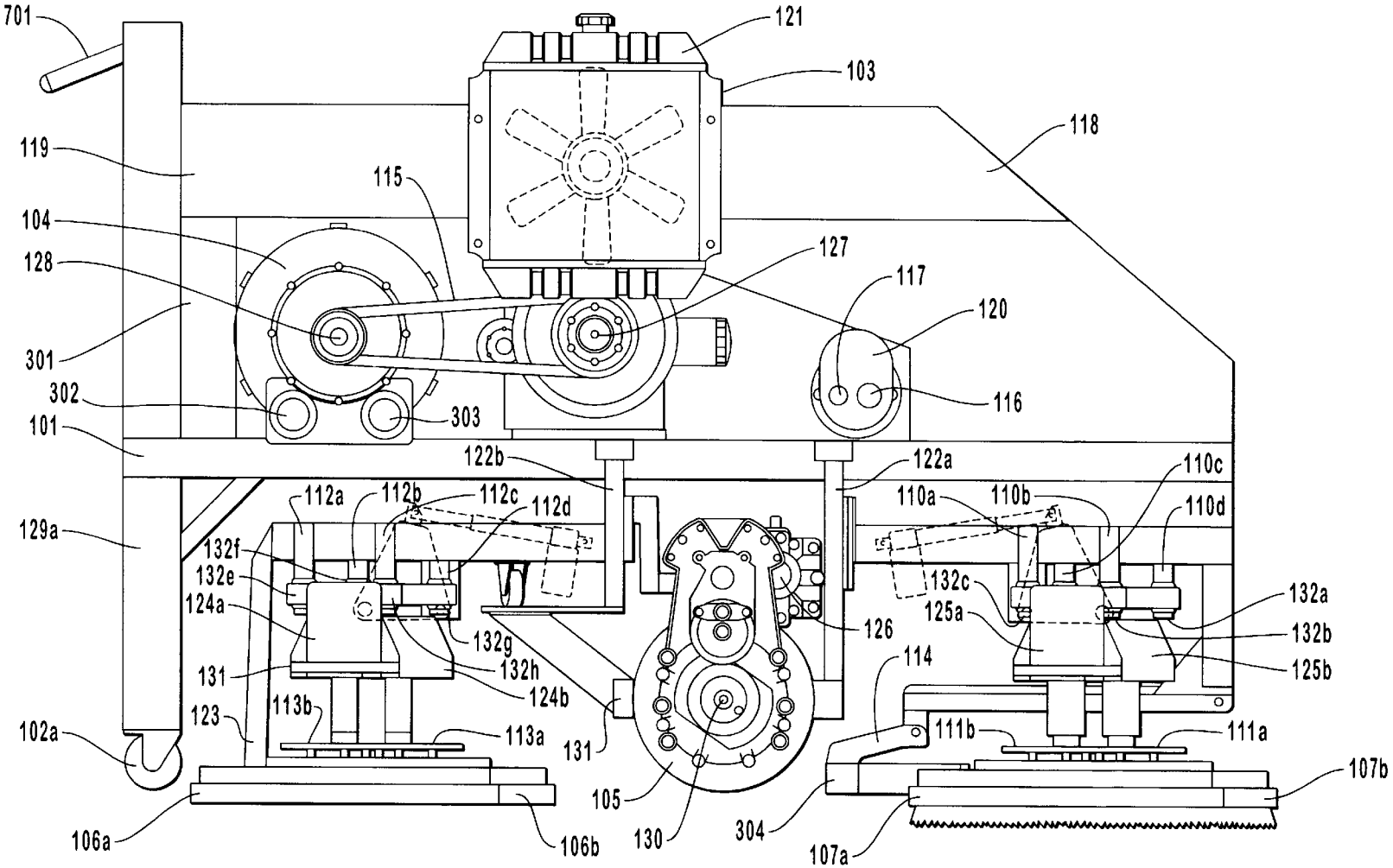
FIG. 1 shows the first side view of the preferred embodiment floor scrubber and buffer invention with the pads rotated to bring them into contact with the floor.

FIG. 1 depicts the first side view of the preferred embodiment floor scrubber and buffer invention with the pads rotated to bring them into contact with the floor. The frame 101 is shown providing attachment points for the major components of the invention. Specifically, these major components of the invention include: the motor 103, the vacuum blower 104, a pump 120, the main drive wheel 105, the hydraulic fluid tank 301, the fresh water tank 119, the recovery tank 118 and, in the preferred embodiment, two scrubbing pads 107*a*, 107*b* and two buffing pads 106*a*, 106*b*. The buffing pads 106*a*, 106*b* are designed to be fully independent and to provide height correction and even pad pressure for each pad. The buffing pads 106*a*, 106*b* rotate side to side on a pivot shaft, thereby allowing the buffing pads 106*a*, 106*b* to follow the scrubbing pads 107*a*, 107*b*, thereby providing an efficient one pass floor cleaning system. The frame 101 includes a handle attachment 701 (shown in FIG. 7) and two rear support casters 102*a*, 102*b*. The preferred frame 101 is composed of one inch by two inch steel tubing welded together to form a fixed frame. Alternative materials could be substituted without departing from the concept of this invention. The support casters 102*a*, 102*b* are provided to support the weight of the scrubber/buffer invention especially when the pads 106*a*, 106*b*, 107*a*, 107*b* are rotated away from contact with the floor. These support casters 102*a*, 102*b*, are fixed in place by being bolted into the legs 129*a*, 129*b* of the frame. The preferred motor 103 provided to power the operation of the scrubber/buffer invention is a commercially available water cooled two cylinder propane engine having an attached radiator 121. A hydraulic tank 301 is provided for holding the hydraulic fluid for use by the hydraulic motors. A propane tank 207 is provided for holding the propane fuel for the motor 103. The motor 103 is fixed to the frame 101 through the use of standard bolts and nuts. Power is provided by the motor 103 to the vacuum blower 104 by a belt 115, preferably an A-line solid belt, which connects the motor shaft 127 to the blower shaft 128, preferably using a flywheel PTO driving the regenerative blower 104 using a tensioner to engage and drive the blower 104 The blower shaft 128 is preferably fitted with a fixed bore sheave. The current preferred motor 103 is a 22 horsepower model FD 661 D available from Kawasaki Motors. The vacuum blower 104 is fixed to the frame 101 through the use of standard bolts and nuts. The vacuum blower 104 is provided with a vacuum input opening 302 and a blower outlet opening 303. The purpose of the vacuum blower 104 is to provide the mechanism for removing residue and water from the floor following the use of the scrubbing pads 107*a*, 107*b*. The vacuum input opening 302 is connected by rubber tubes to the recovery tank 118 which in turn is connected to the squeegee attachment 304, via rubber tubes, which follows behind the scrubbing pads 107*a*, 107*b* to collect residue and water. The squeegee attachment 304 is held in place by a squeegee arm 114. The residue and water collected by the squeegee attachment 304 is collected and held in the recovery tank 118. The preferred recovery tank 118 holds 33.5 gallons and is composed of ABS plastic. Alternative recovery tank 118 sizes and materials can be substituted without departing from the concept of this invention. A hydraulic pump 120 provides power to the hydraulic motors 124*a*, 124*b*, 125*a*, 125*b*. The preferred fresh water tank 119 is designed to hold 27 gallons of water and/or cleaning fluid and is composed of ABS plastic, although alternative materials could be substituted without departing from the concept of this invention. Water is gravity feed from the fresh water tank 119 to the front pads 107*a*, 107*b*. The hydraulic pump 120 is a commercially available pump, the preferred embodiment of which is provided by Gresen. The hydraulic pump 120 is fixed to the frame by standard bolts and nuts. A main drive wheel 105 wheel is provided in the center of this scrubber/buffer invention. In the preferred embodiment the main drive wheel 105 is a commercially available rubber wheel, typically six inches wide and with an outer diameter of ten inches. The main drive wheel 105 is provided to assist the user in moving this scrubber/buffer invention as well as in providing support for the weight of the scrubber/buffer. The main drive wheel 105 is mounted on an axle 130 within a support structure 131, which in turn is fixed by welds to the frame 101. The main drive wheel 105 is driven by a hydraulic transaxel 126 which is self contained and powered by belt 202. Support members 122*a*, 122*b* are provided to fix the drive gear 126 and the main drive wheel to the frame 101. The pump 120 also provides power to turn hydraulic motors 601*a,b*, and 602*a,b*. Each scrubber pad 107*a*, 107*b* is provided with independent spring loaded mounts 111*a*, 111*b*, which are capable of independently adjusting each pads 107*a*, 107*b* position. The buffer pads 106*a*, 106*b* are provided with permanently mounted flexible disks 113*a*, 113*b* for maintaining the relative vertical positioning of the pads 106*a*, 106*b*. High speed direct drive hydraulic gear motors 124*a*, 124*b* are provided to drive the buffer pads 106*a*, 106*b* in the preferred embodiment at 1200 rotations per minute (rpm). Low speed direct drive hydraulic gear motors 125*a*, 125*b* are provided to drive the scrubbing pads 107*a*, 107*b* in the preferred embodiment at 200 rpm. The gear motors 124*a*, 124*b*, 125*a*, 125*b*, and the pads 106*a*, 106*b*, 107*a*, 107*b* are held in place by high strength linear shafts 110*a*, 110*b*, 110*c*, 110*d*, 112*a*, 112*b*, 112*c*, 112*d*, preferably Thompson Class L linear shafts, which are fixed to the frame 101 via a number of pivot points 702*a, b, c, d*. A heavy duty linear slide bearing 132*a,b,c,d,e,f,g,h* is provided to give independent vertical travel for each pad driver. Each hydraulic motor 124*a*, 124*b*, 125*a*, 125*b* is provided with an electronic safety kill switch 131, which is provided to cut power to the hydraulic motors when the pads are being rotated or changed by the user. The scrubbing and buffing pads 106*a*, 106*b*, 107*a*, 107*b* are provided, by the use of the independent gear motors 124*a*, 124*b*, 125*a*, 125*b* and linear shafts 110*a*, 110*b*, 110*c*, 110*d*, with the capability of providing height correction and even pad pressures for each pad 106, 106*b*, 107*a*, 107*b*. An additional castered support 123 is provided behind the buffing pads 106*a*, 106*b* provides the capability for the rear pads to track or follow the front pads. The preferred embodiment of the scrubber/buffer invention is 60.75 inches long, 46 inches tall, and 35.875 inches wide. Alternative embodiments of the invention could be of different sizes without departing from the concept of this invention.

Figure 2:
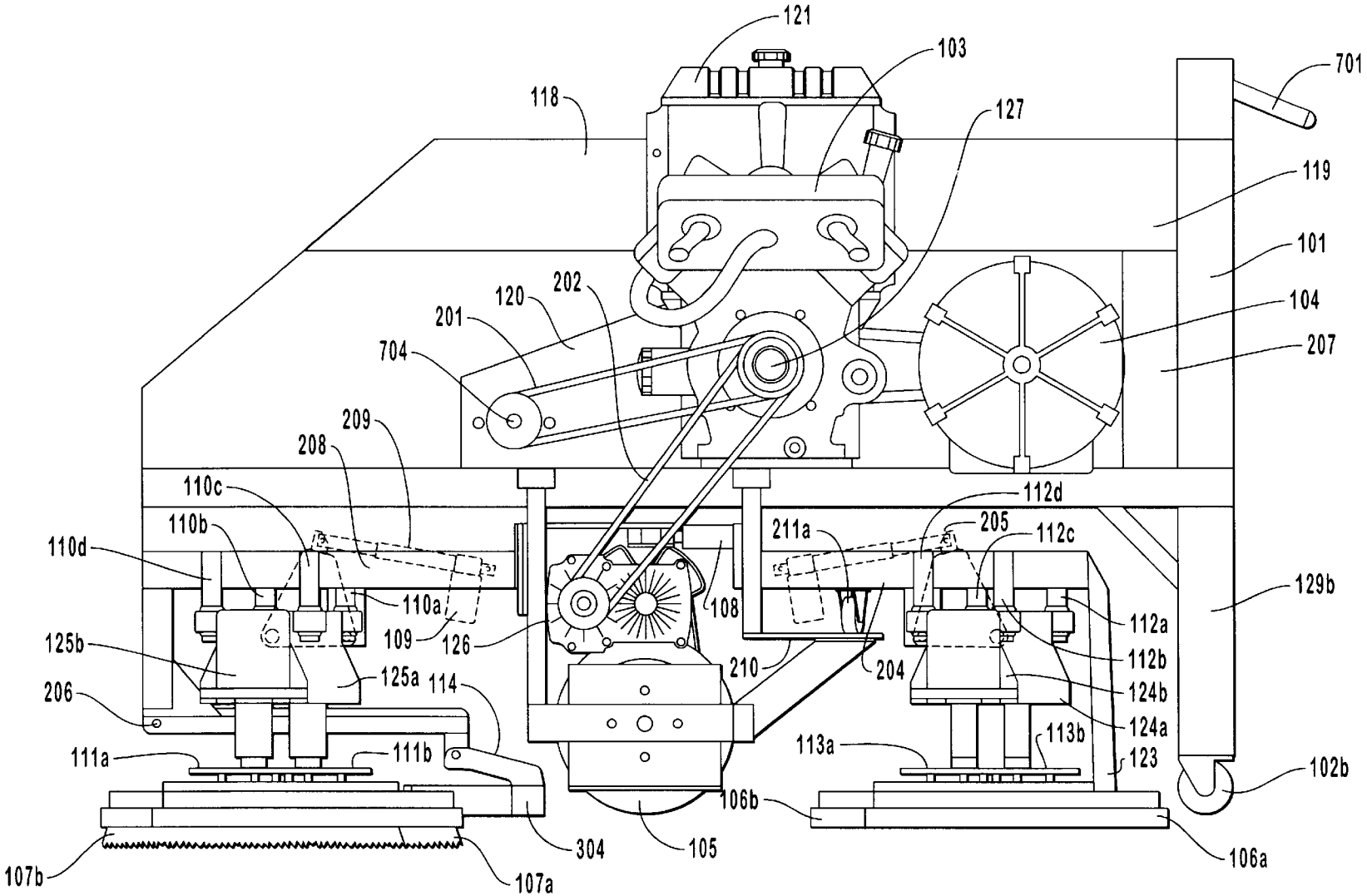
FIG. 2 shows the second side view of the preferred embodiment floor scrubber and buffer invention with the pads rotated to bring them into contact with the floor.

FIG. 2 depicts the other or second side view of the preferred embodiment floor scrubber/buffer invention with the pads 106*a*, 106*b*, 107*a*, 107*b* rotated to bring them into contact with the floor. This view, while showing many of the components discussed above, provides additional detail of the drive system which using power from the motor 103 delivers power to the hydraulic pump 120 and the hydrostatic transmission 126. The hydraulic pump 120 is connected to the engine 103 facing for a secure mount. In particular, a belt drive 201 is provided between the drive shaft 127 of the motor 103 and the pump shaft 704 and a second belt drive 202 is provided between the drive shaft 127 of the motor 103 and the drive gear 126. Preferably, a Rosta belt tensioner is provided to give the belt 201 the required belt tension for the torque value of the pump 120. A propane tank is provided 207 in communication with the direct drive hydraulic gear motors 124*a*, 124*b*, 125*a*, 125*b*. Also shown is the transmission mount 203 of the drive wheel 105 which connects the drive wheel 105 to the hydrostatic transmission 126. The hydraulic pump 120 is also shown. A rear swing arm 204 which is supported by a frame mounted track 210 within which two fixed casters 211*a,b* travel to provide support so that the swing arm cannot drop lower than required. The rear pad pivot 205 permits the rear pads to be lifted simultaneously. A squeegee pivot 206 is designed to travel both side to side and vertically. A lifter 208 is provided to allow the pads 107*a,b* to remain independent while providing for the lifting of the pads 107*a,b*. The lifter 208 is connected to a second lifting cam for raising the squeegee 304. A linear actuator 209, typically a 12 volt powered device, provides the ability to raise and lower the pads 106*a*, 106*b*, 107*a*, 107*b* and the squeege 304.

Figure 3:
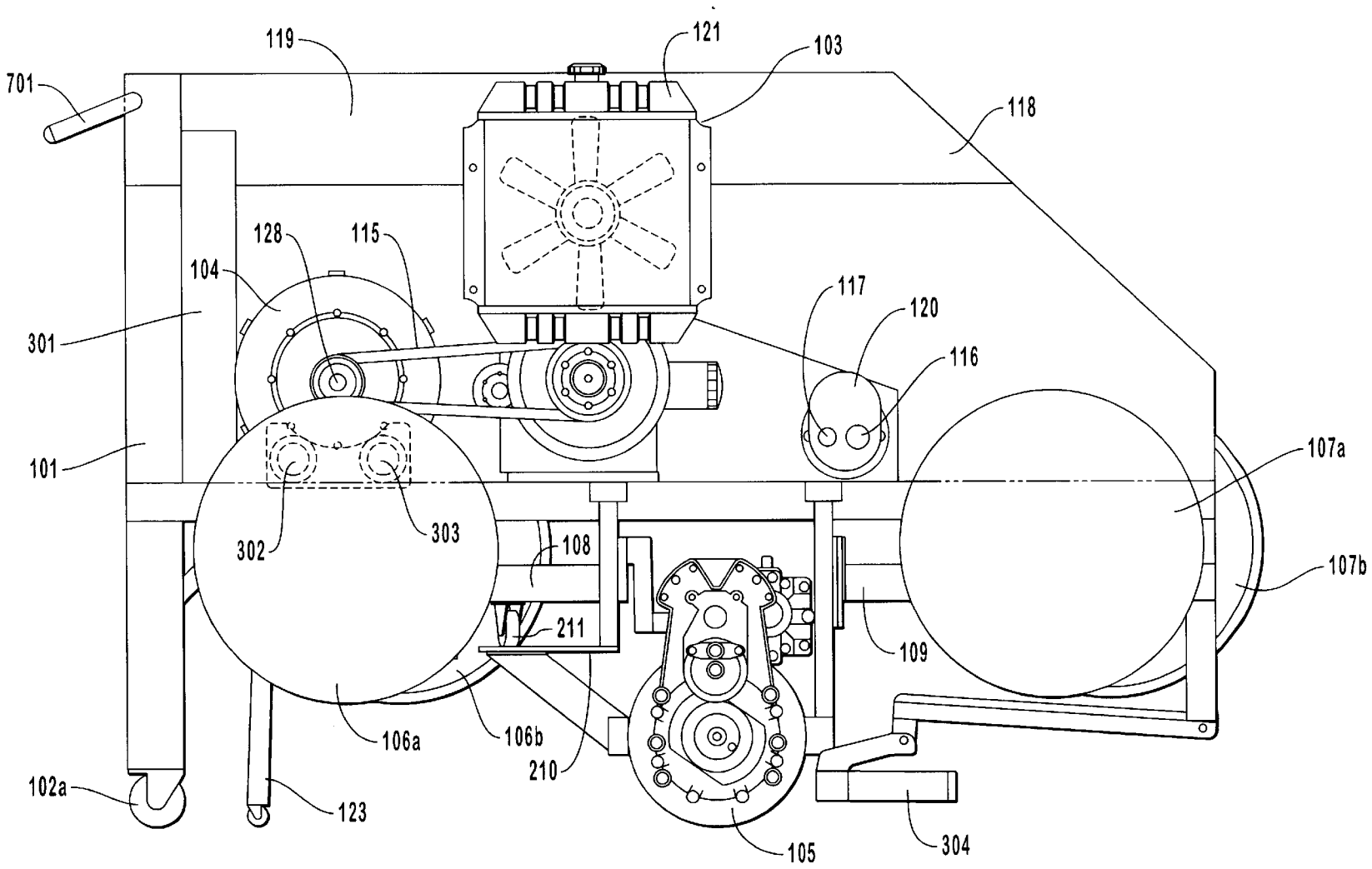
FIG. 3 shows the first side view of the preferred embodiment of the floor scrubber and buffer invention with the pads rotated to permit the pads to be removed and replaced or to permit the floor scrubber and buffer invention to be moved on wheels.

FIG. 3 depicts the first side view of the preferred embodiment of the floor scrubber and buffer invention with the pads rotated to permit the pads to be removed and replaced or to permit the floor scrubber and buffer invention to be moved on wheels. In this configuration, the pads 106*a*, 106*b*, 107*a*, 107*b* are rotated to remove them from contact with the floor. In this configuration the pads 106*a*, 106*b*, 107*a*, 107*b* can be easily removed, replaced and/or serviced. Also, this configuration is useful for moving the scrubber/buffer invention without inducing wear on the pads. When moving this scrubber/buffer invention the weight is supported by the main drive wheel 105 and the rear support casters 102*a*, 102*b*. It should also be noted that in this configuration the squeegee 304 is lifted away from the floor by along with the raising of the scrubber pads 107*a*, 107*b*. This view shows a hydraulic tank 301, which is provided in the preferred embodiment, to store hydraulic fluid. Also shown are the vacuum inlet 302 and outlet 303.

Figure 4:
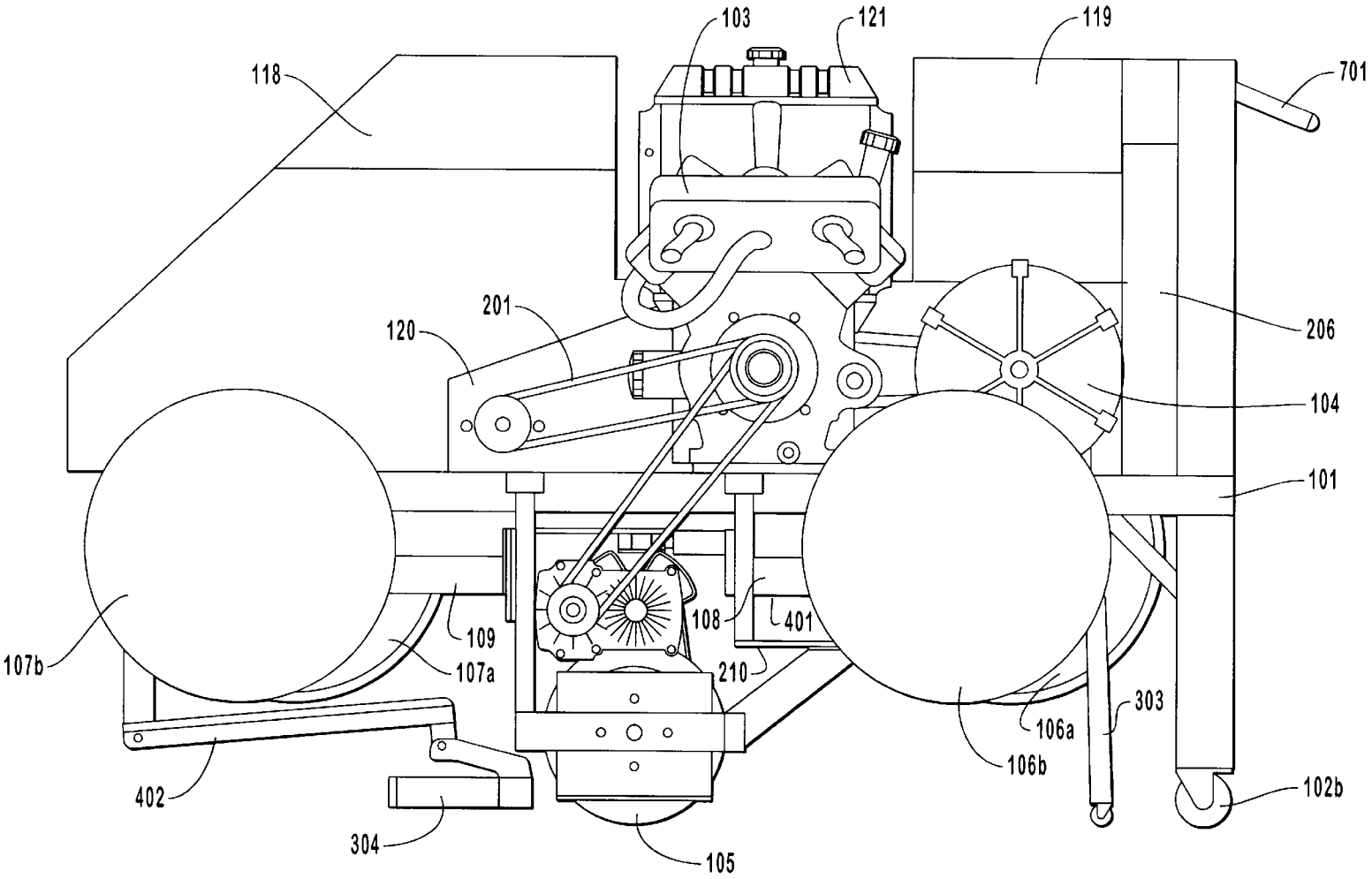
FIG. 4 shows the second side of the preferred embodiment of the floor scrubber and buffer invention with the pads rotated to permit the pads to be removed and replaced or to permit the floor scrubber and buffer invention to be moved on wheels.

FIG. 4 depicts the second side of the preferred embodiment of the floor scrubber and buffer invention with the pads rotated to permit the pads to be removed and replaced or to permit the floor scrubber and buffer invention to be moved on wheels. This view is provided to permit the reader a complete understanding of the invention. No additional components of the invention are shown in this figure. The rear swing arm 401 remains at the same height even when the pads 106*a*, 106*b* are raised. The support track 210 and support wheels 211*a*, 211*b* are provided to maintain the required height. The squeege 304 is shown with the squeegee lift support 402, both of which are lifted with the front pads 107*a*, 107*b*. This permits the machine to function not only as a combination scrubber and buffer, but also in a buffer only mode.

Figure 5:
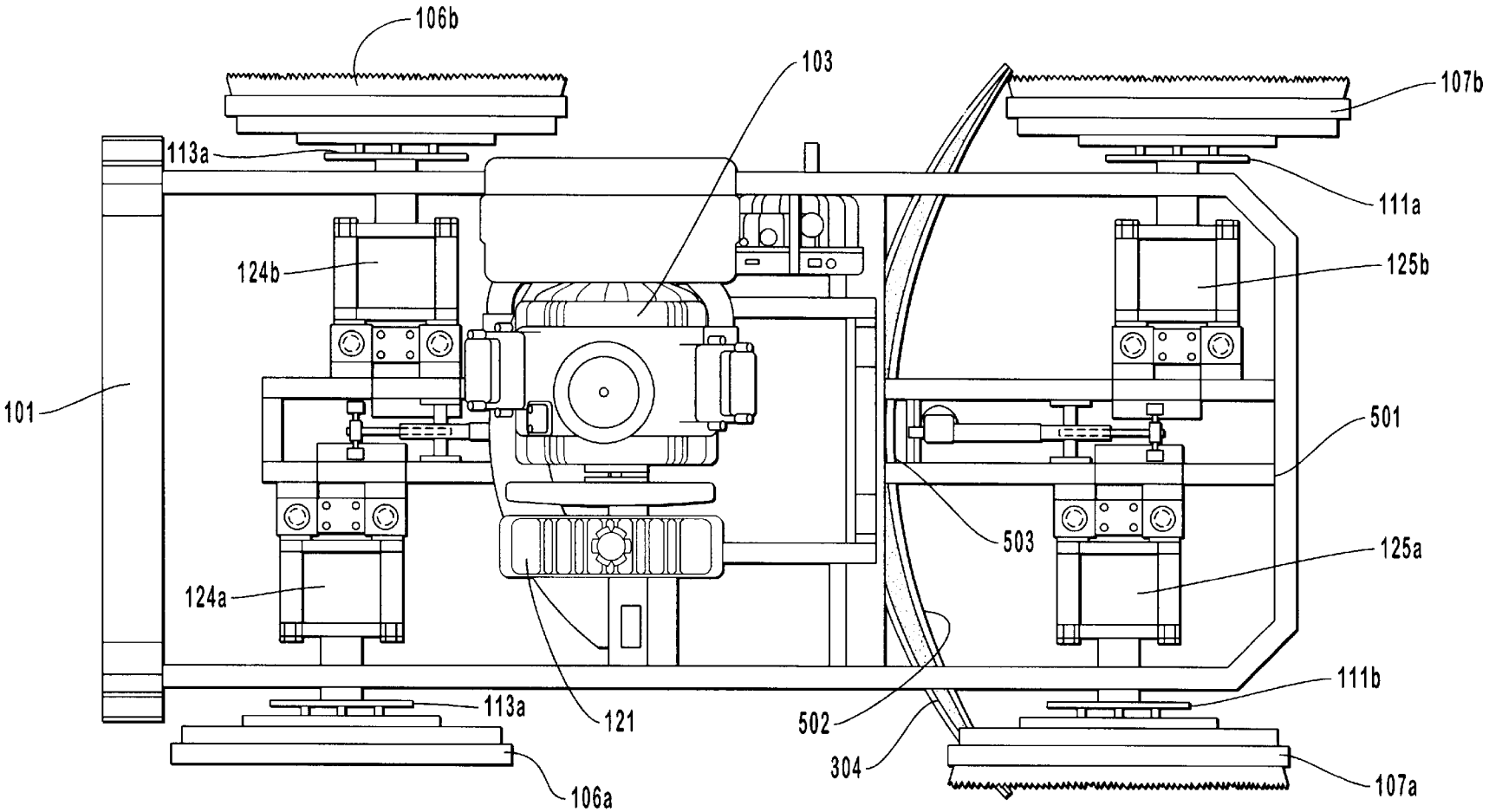
FIG. 5 shows a top-down view of the preferred embodiment of the floor scrubber and buffer invention with the pads rotated to permit the pads to be removed and replaced or to permit the floor scrubber and buffer invention to be moved on wheels.

FIG. 5 depicts a top-down view of the preferred embodiment of the floor scrubber and buffer invention with the pads rotated to permit the pads to be removed and replaced or to permit the floor scrubber and buffer invention to be moved on wheels. This view shows additional detail concerning the frame 101, specifically its box type configuration or alternatively a heavy duty steel tubing frame, and the squeegee 304, specifically the generally curved shape opening following the scrubbing pads 107*a*, 107*b*. The area for the squeegee return 501 is identified as is the area 502 for the inlet port 177 of the vacuum 104. Also, shown is the vacuum blower 104 shaft 128 belt attachment 503. In this view, for clarity, the belts 115, 201, 202 and the tanks 118, 119, 301, 207 are not shown. The propane tank 207 is shown relative to the hydraulic tank 301. Also, shown is the shifter 503 which provides the user with directional control, that is forward, reverse and neutral, by the multi-positional shifter (not shown) positioned on the handle 701. The forward/reverse movement control is provided by the transaxie 504.

Figure 6:
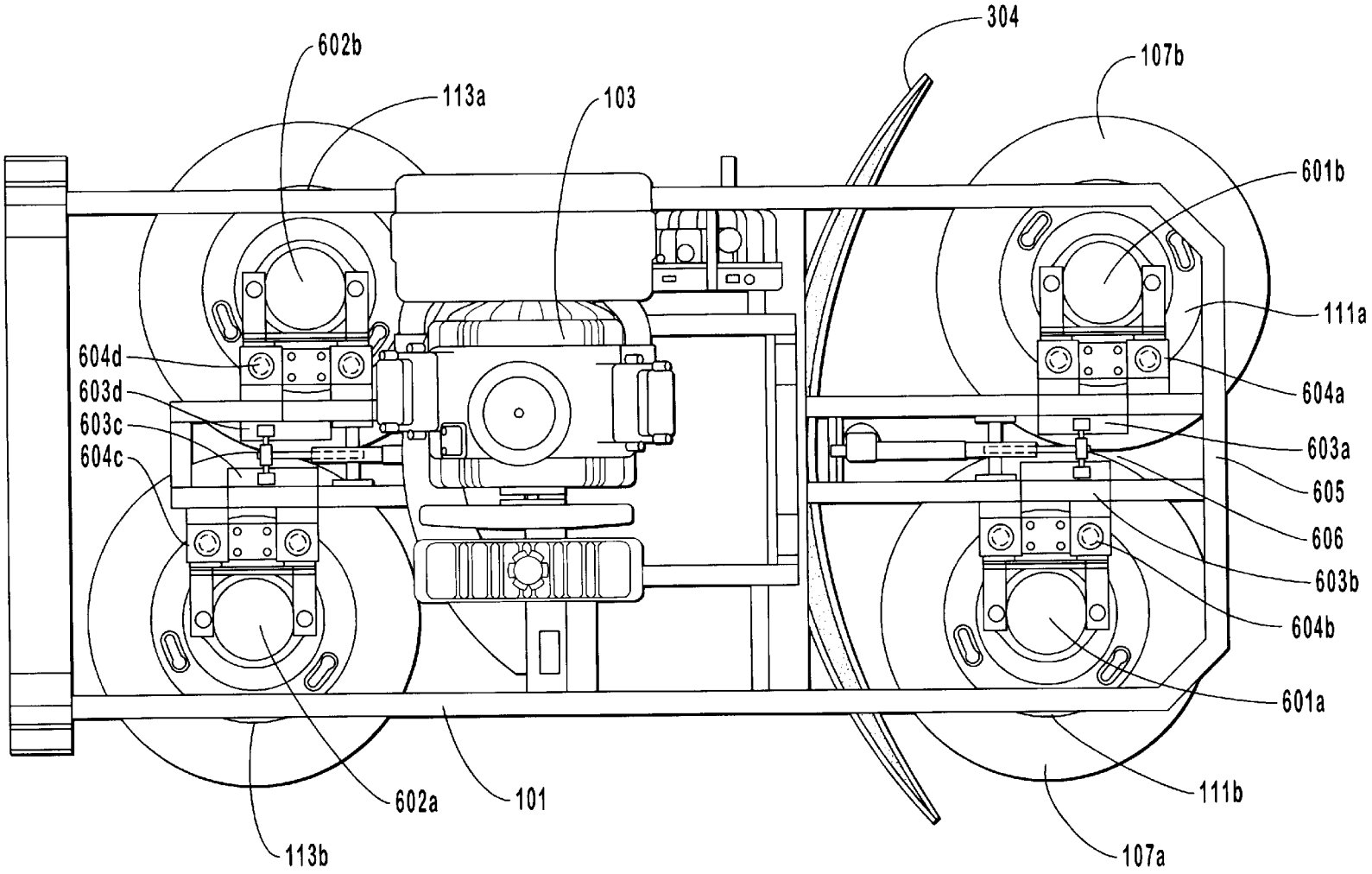
FIG. 6 shows a top-down view of the preferred embodiment of the floor scrubber and buffer invention with the pads rotated so as to bring them into contact with the floor for scrubbing and buffing.

FIG. 6 depicts a top-down view of the preferred embodiment of the floor scrubber and buffer invention with the pads rotated so as to bring them into contact with the floor for scrubbing and buffing. This view shows additional detail of the pad 106*a*, 106*b*, 107*a*, 107*b* attachments 602*a*, 602*b*, 602*c*, 602*d* to the hydraulic motors 124*a*, 124*b*, 125*a*, 125*b*. Lifting cams 603*a,b,c,d* are attached to bearing blocks 604*a,b,c,d* for lifting the pads 106*a,b*, 107*a,b*. The preferred squeegee 304 is 37 inches long with a radius of 30 inches. The squeegee pivot point 605 is shown in its approximate location. Note that the pads 106*a,b*, 107*a,b* are offset, preferably by 3 inches, to ensure that there is no gap 606 in the cleaning path. The frame 101 is designed to permit the necessary pad overhang to permit cleaning and buffing access under shelves.

Figure 7:
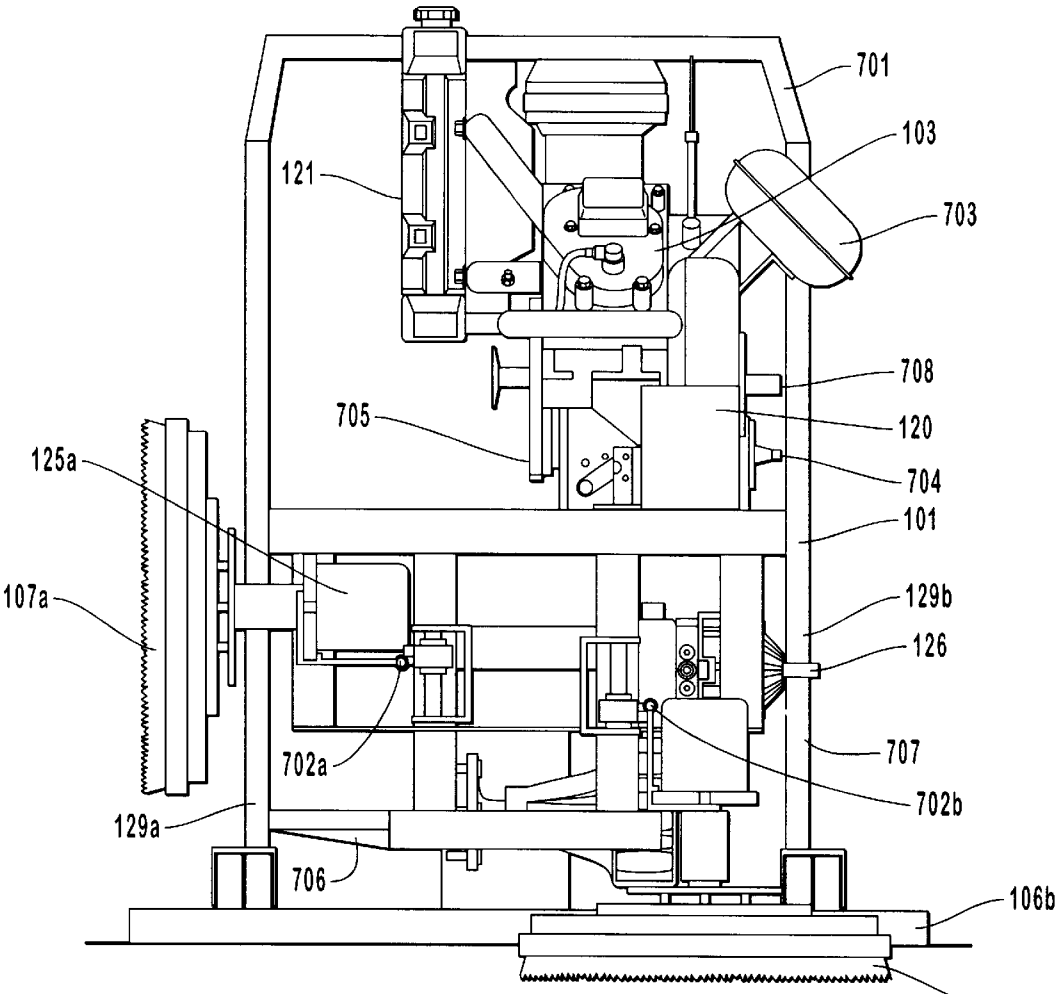
FIG. 7 shows a front view of the preferred embodiment of the floor scrubber and buffer invention with one set of the pads rotated to permit the pads to be removed and replaced or to permit the floor scrubber and buffer invention to be moved on wheels while the other set of pads remain in contact with the floor.

FIG. 7 depicts a front view of the preferred embodiment of the floor scrubber and buffer invention with one set of pads rotated to permit the pads to be removed and replaced or to permit the floor scrubber and buffer invention to be moved on wheels and the other set of pads left in contact with the floor. This view provides additional detail of the pivot points 702*a*, 702*b* which provides the capability of pivoting the pads 106*a*, 106*b*, 107*a*, 107*b* from a horizontal, in contact with the floor, to a vertical position, raised out of contact with the floor. This view also shows additional frame 101 detail, specifically showing the preferred handle 701. The pivot points 702*a,b* are shown providing for 90 degree rotation thereby allowing easy access to the pads for rotating or changing. The motor 103 is provided with a low tone muffler 703 for quiet operation. The hydraulic pump shaft 704, the hydrostatic transmission shaft 707 and the motor drive shaft 708 are shown without the connecting belt for clarity. A mount 706 is provided for holding a 12 volt battery. A flywheel 705 is shown, opposite the motor shaft 708, which provides via a belt 115 (not shown in this figure) the power to the vacuum shaft 128.

Figure 8:
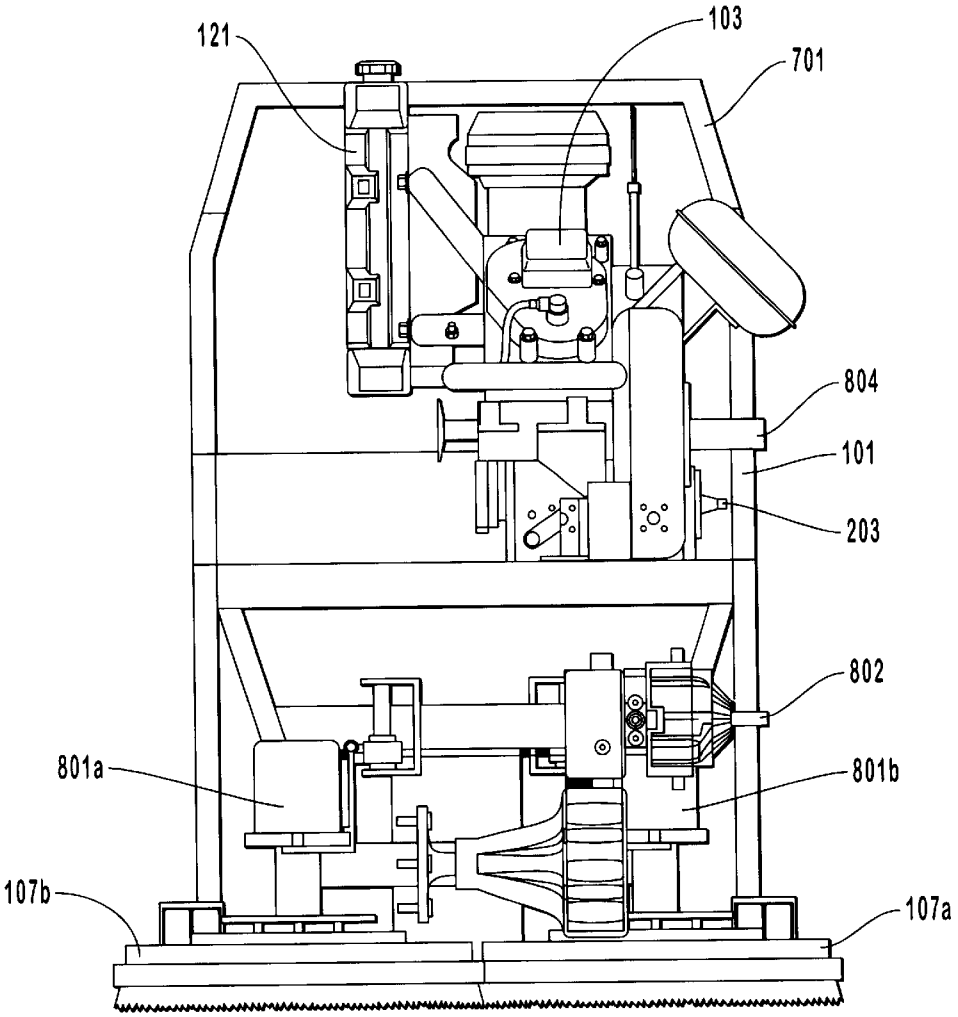
FIG. 8 shows a front view of the preferred embodiment of the floor scrubber and buffer invention with the pads rotated so as to bring them into contact with the floor for scrubbing and buffing.

FIG. 8 depicts a front view of the preferred embodiment of the floor scrubber and buffer invention with the pads rotated so as to bring them into contact with the floor for scrubbing and buffing. This view provides additional detail of the hydraulic gear motors 801*a*, 801*b*, as well as the hydrostatic transmission shaft 802, the hydraulic pump shaft 803 and the motor shaft drive shaft 804, with the belts removed to provide additional details.

Figure 9C:
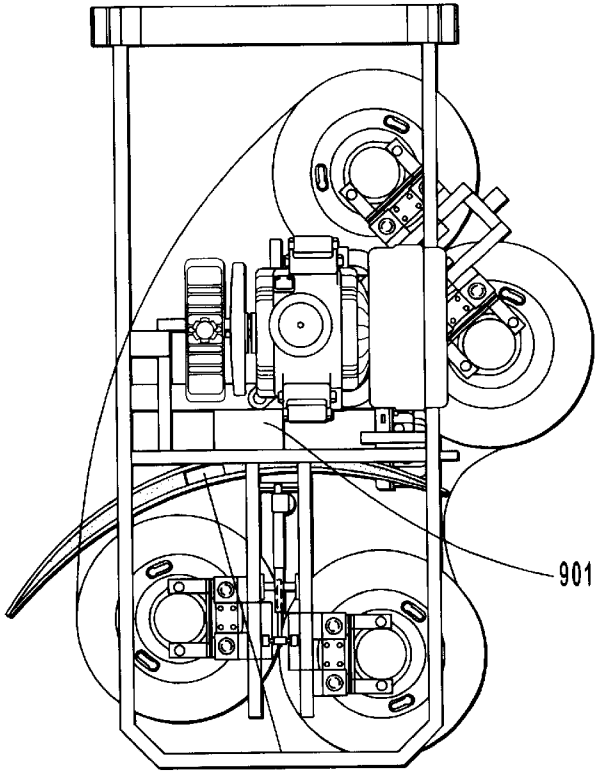
FIG. 9 shows the turning pattern of the invention, with 9*a* showing a left-hand turn, 9*b* showing a forward, no turn, and 9*c* shows a right-hand turn.
Figure 9B:
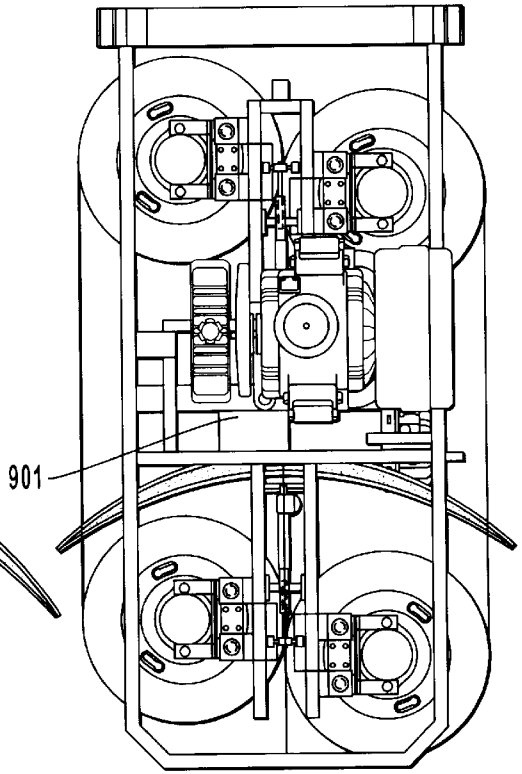
Figure 9A:
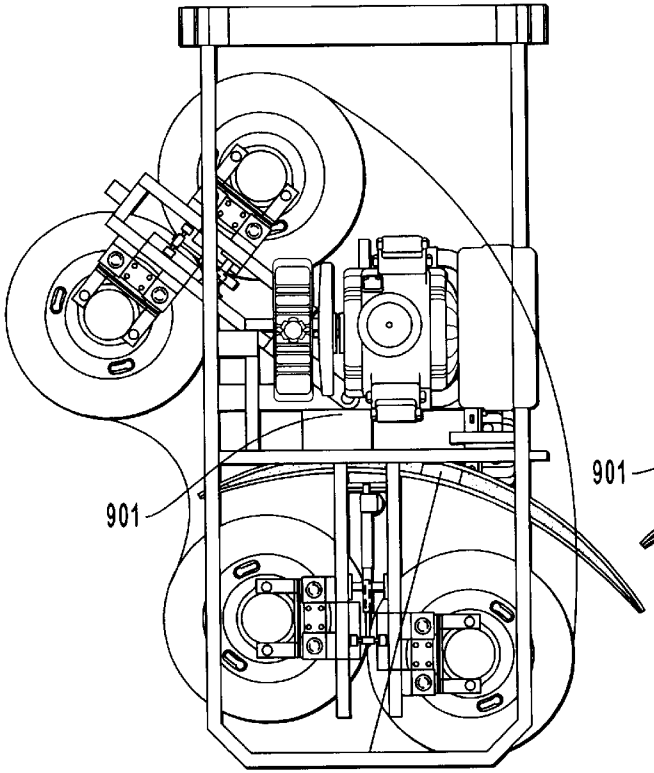

FIG. 9 shows the turning pattern of the invention, with 9*a* showing a left-hand turn, 9*b* showing a forward, no turn, and 9*c* shows a right-hand turn. One of the innovative features of this invention is the ability to rotate the buffer pads 106*a*, 106*b* out of alignment with the scrubber pads 107*a*, 107*b* to make turning the scrubber/buffer easier and to allow the rear pads 106*a*, 106*b* to track or follow the front pads 107*a*, 107*b*. A pivot point 901 is provided and shown in the approximate center of the scrubber/buffer assembly.

Figure 10A:
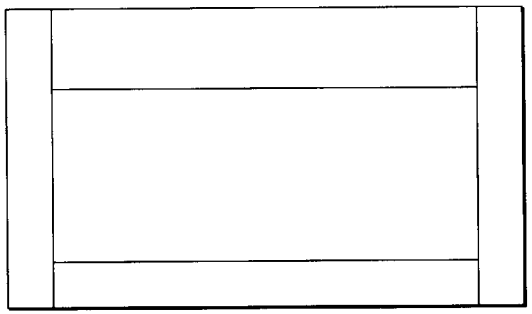
FIG. 10 shows the water and cleaning chemical tanks used in the preferred embodiment of the invention.
Figure 10B:
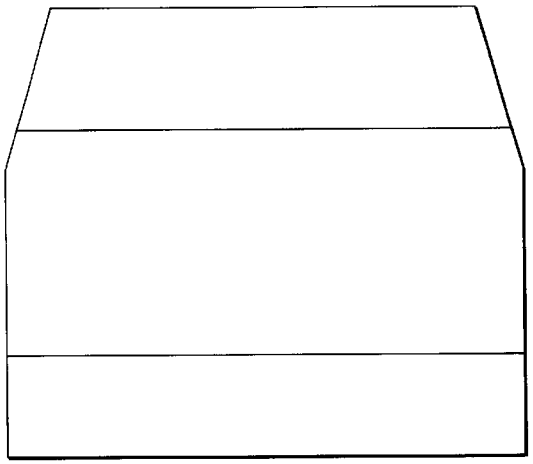
Figure 10C:
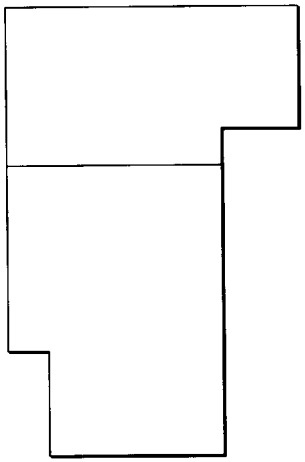
Figure 10D:
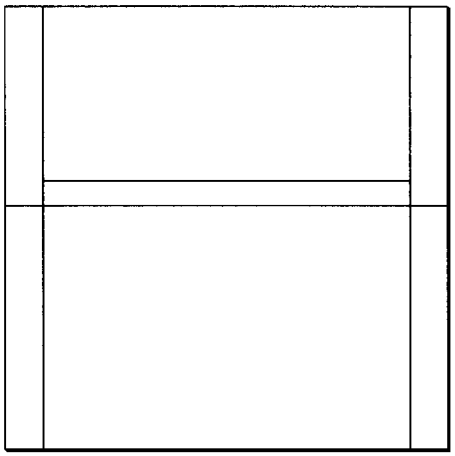
Figure 10F:
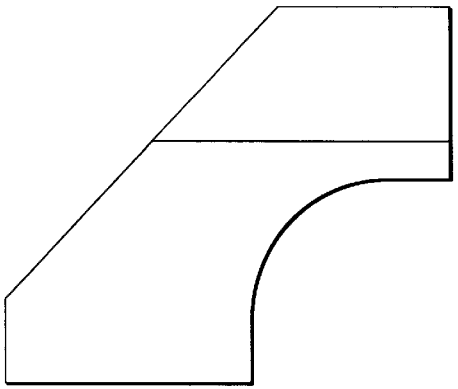
Figure 10E:
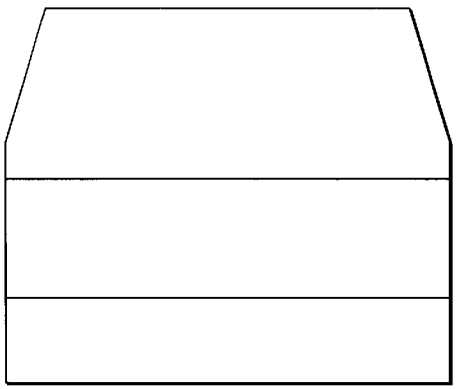

FIGS. 10*a* through 10*f* provide details of the preferred fresh water tank and recovery tank. FIG. 10*a* shows the top view of the fresh water tank. FIG. 10*b* shows the end view of the fresh water tank. FIG. 10*c* shows the side view of the fresh water tank. FIG. 10*d* shows the top view of the recovery tank. FIG. 10*e* shows the end view of the recovery tank. FIG. 10*f* shows the side view of the recovery tank.

The described embodiment of the invention is provided to give the reader a complete understanding of the preferred embodiment of the invention and is to be considered in all respects as illustrative and not as restrictive. Although this embodiment, described in the drawings and the detailed description, includes specific components, quantities of components, dimensions, motors, and materials, the invention is not limited thereto. The scope of this invention, therefore, indicated by the appended claims rather than by the foregoing description. All changes which come within the meaning and range of equivalency of these claims are to be embraced within their scope.

We claim:

1. A floor scrubber and buffer device comprising:

(A) a frame;

(B) a first motor mounted on said frame and wherein said first motor further comprises an internal combustion engine;

(C) a first pad attached to said frame for scrubbing the floor;

(D) a second motor mechanically connected to said first pad to provide power for inducing motion on said first pad;

(E) a second pad attached to said frame for buffing the floor; and (F) a third motor mechanically connected to said second pad to provide power for inducing motion on said second pad.

2. A floor scrubber and buffer device comprising:

(A) a frame;

(B) a first motor mounted on said frame, and wherein said first motor uses propane fuel;

(C) a first pad attached to said frame for scrubbing the floor;

(D) a second motor mechanically connected to said first pad to provide power for inducing motion on said first pad;

(E) a second pad attached to said frame for buffing the floor; and (F) a third motor mechanically connected to said second pad to provide power for inducing motion on said second pad.

3. A floor scrubber and buffer device comprising:

(A) a frame;

(B) a first motor mounted on said frame;

(C) a first pad attached to said frame for scrubbing the floor, and wherein said first pad is pivotally attached to said frame permitting said first pad to be pivoted out of contact with the floor;

(D) a second motor mechanically connected to said first pad to provide power for inducing motion on said first pad;

(E) a second pad attached to said frame for buffing the floor; and (F) a third motor mechanically connected to said second pad to provide power for inducing motion on said second pad.

4. A floor scrubber and buffer device comprising:

(A) a frame;

(B) a first motor mounted on said frame; (C) a first pad attached to said frame for scrubbing the floor;

(D) a second motor mechanically connected to said first pad to provide power for inducing motion on said first pad, and wherein said second motor is a hydraulic motor;

(E) a second pad attached to said frame for buffing the floor; and (F) a third motor mechanically connected to said second pad to provide power for inducing motion on said second pad.

5. A floor scrubber and buffer device comprising:

(A) a frame;

(B) a first motor mounted on said frame;

(C) a first pad attached to said frame for scrubbing the floor;

(D) a second motor mechanically connected to said first pad to provide power for inducing motion on said first pad;

(E) a second pad attached to said frame for buffing the floor; and (F) a third motor mechanically connected to said second pad to provide power for inducing motion on said second pad; and (G) a squeegee attached to said frame and following said first pad to remove scrubbing residue prior to buffing the floor.

6. A floor scrubber and buffer device comprising:

(A) a frame;

(B) a first motor mounted on said frame;

(C) a first pad attached to said frame for scrubbing the floor;

(D) a second motor mechanically connected to said first pad to provide power for inducing motion on said first pad;

(E) a second pad attached to said frame for buffing the floor; and (F) a third motor mechanically connected to said second pad to provide power for inducing motion on said second pad; and (G) a second tank for holding residue removed from the floor.

7. A floor scrubber and buffer device comprising:

(A) a frame;

(B) a first motor mounted on said frame;

(C) a first pad attached to said frame for scrubbing the floor;

(D) a second motor mechanically connected to said first pad to provide power for inducing motion on said first pad;

(E) a second pad attached to said frame for buffing the floor; and (F) a third motor mechanically connected to said second pad to provide power for inducing motion on said second pad; and (G) a pivot point for pivoting said second pad for buffing relative to said first pad for scrubbing.

* * * * *